US009330548B2

(12) United States Patent
Cantave

(10) Patent No.: US 9,330,548 B2
(45) Date of Patent: May 3, 2016

(54) WIRELESS PERIMETER INTRUSION DETECTION SYSTEM

(71) Applicant: Guilford Cantave, Orlando, FL (US)

(72) Inventor: Guilford Cantave, Orlando, FL (US)

(73) Assignee: Fermitron Inc., Orlando, FL (US)

( * ) Notice: Subject to any disclaimer, the term of this patent is extended or adjusted under 35 U.S.C. 154(b) by 0 days.

(21) Appl. No.: 14/188,750

(22) Filed: Feb. 25, 2014

(65) Prior Publication Data

US 2015/0243144 A1 Aug. 27, 2015

(51) Int. Cl.

| | |
|---|---|
| ***G08B 13/00*** | (2006.01) |
| ***G08B 13/24*** | (2006.01) |
| *G08B 25/10* | (2006.01) |

(52) U.S. Cl.

CPC ..... *G08B 13/2491* (2013.01); *G08B 25/10* (2013.01)

(58) Field of Classification Search

CPC ..... B60Q 9/006; B60Q 9/007; B60Q 9/008; G01S 13/726; G01S 13/878; G01S 13/931; G01S 2013/9364; G01S 2013/9378; G01S 2013/9382; G01S 2013/9389; G01S 7/003; G08G 1/16; G08G 1/161; G08B 13/122

USPC ..... 340/541, 539.22, 556, 566, 340/539.16–539.17, 693.1, 539.1, 552–555, 340/557

See application file for complete search history.

(56) References Cited

U.S. PATENT DOCUMENTS

| | | | | |
|---|---|---|---|---|
| 6,774,790 | B1 * | 8/2004 | Houston | 340/556 |
| 7,196,330 | B2 * | 3/2007 | Noguchi | 250/342 |
| 2006/0238407 | A1 * | 10/2006 | Bourdelais et al. | 342/90 |
| 2013/0335219 | A1 * | 12/2013 | Malkowski | 340/539.22 |
| 2015/0009031 | A1 * | 1/2015 | Bedros et al. | 340/566 |

* cited by examiner

*Primary Examiner* — Daniel Previl

(74) *Attorney, Agent, or Firm* — Jason T. Daniel, Esq.; Daniel Law Offices, P.A.

(57) ABSTRACT

A wireless perimeter intrusion detection system includes a controller and at least one perimeter generation unit having a weatherproof housing, at least one movement detection sensor, an alarm, an input unit and a communication unit.

20 Claims, 6 Drawing Sheets

WIRELESS PERIMETER INTRUSION DETECTION SYSTEM

TECHNICAL FIELD

The present invention relates generally to alarm devices, and more particularly to a networked wireless alarm system for outdoor use in order to secure a perimeter.

BACKGROUND

The statements in this section merely provide background information related to the present disclosure and may not constitute prior art.

Alarm systems for protecting vehicles, homes and buildings are well known in the art. Many of these systems are beginning to incorporate outdoor motion sensors which are tied into the fixed building system in order to detect an intruder before they can enter the building. In each of these cases, the motion sensors are easily detectable to the naked eye, and rely on power provided from the building itself for the device operation.

Although useful for their intended purpose, these known systems are wholly inadequate for outdoor use wherein no hard wired infrastructure can be provided, and cannot operate to establish a dynamic perimeter which is capable of being quickly setup, taken down and moved.

Accordingly, it would be beneficial to provide a wireless perimeter intrusion system that is capable of monitoring virtually any environment to which a user may choose while not suffering from the drawbacks of the devices described above.

SUMMARY OF THE INVENTION

The present invention is directed to a wireless perimeter intrusion detection system. One embodiment of the present invention can include a controller that is in communication with one or more perimeter generation units (PGU) via a network.

Another embodiment of the present invention can include one or more PGU devices, each having a weatherproof housing, a power source, a motion detector and an alarm. Each of the one or more PGU devices can include an adjustable coverage area and coverage radius for establishing a perimeter through which movement can be detected. Each of the one or more PGU devices can communicate directly with the controller and can also communicate with each other.

Yet another embodiment of the present invention can include a plurality of PGU devices which can be centrally controlled by the controller. Upon detecting movement by a single PGU device, the alarm located on each of the PGU devices can be activated.

This summary is provided merely to introduce certain concepts and not to identify key or essential features of the claimed subject matter.

BRIEF DESCRIPTION OF THE DRAWINGS

Presently preferred embodiments are shown in the drawings. It should be appreciated, however, that the invention is not limited to the precise arrangements and instrumentalities shown.

DETAILED DESCRIPTION OF THE INVENTION

Figure 1:
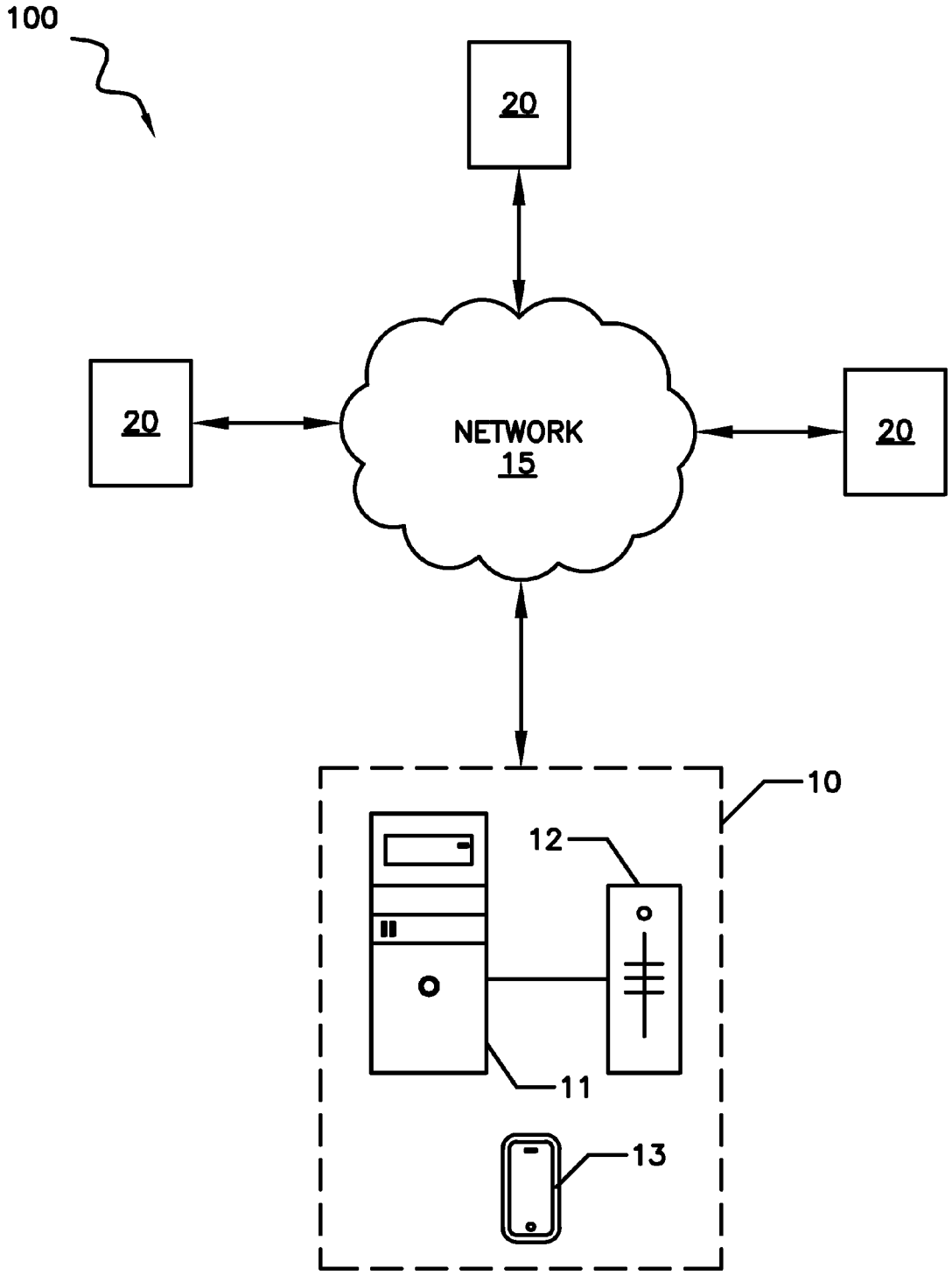
FIG. 1 is a simplified block diagram of an exemplary wireless perimeter intrusion detection system that is useful for understanding the inventive concepts disclosed herein.

While the specification concludes with claims defining the features of the invention that are regarded as novel, it is believed that the invention will be better understood from a consideration of the description in conjunction with the drawings. As required, detailed embodiments of the present invention are disclosed herein; however, it is to be understood that the disclosed embodiments are merely exemplary of the invention which can be embodied in various forms. Therefore, specific structural and functional details disclosed herein are not to be interpreted as limiting, but merely as a basis for the claims and as a representative basis for teaching one skilled in the art to variously employ the inventive arrangements in virtually any appropriately detailed structure. Further, the terms and phrases used herein are not intended to be limiting but rather to provide an understandable description of the invention.

Identical reference numerals are used for like elements of the invention or elements of like function. For the sake of clarity, only those reference numerals are shown in the individual figures which are necessary for the description of the respective figure. For purposes of this description, the terms "upper," "bottom," "right," "left," "front," "vertical," "horizontal," and derivatives thereof shall relate to the invention as oriented in FIG. 2B.

A wireless perimeter intrusion detection system, as described herein, can operate to allow users to establish an area/perimeter wherein any movement detected within or entering the boundary of the perimeter can activate an alarm. In this regard, the perimeter can be established by one or more perimeter generation units (PGU devices) which can operate independently or can be linked together to expand the perimeter. Each of the PGU devices can be placed in any environment, such as an indoor environment or an outdoor environment, for example, in order to detect the presence of trespassers or other individuals entering an area that is monitored by the PGU devices (i.e., the perimeter). By using a plurality of independent PGU devices, the system can offer redundancy in the event of one or more device failures, without leaving the entire perimeter unmonitored.

FIG. 1 illustrates one embodiment of a wireless perimeter intrusion detection system 100 that is useful for understanding the inventive concepts disclosed herein. As shown, the system 100 can include a controller 10 that is in communication with one or more perimeter generation units (PGU) 20 via a network 15.

As described herein, the controller 10 can include one or more individual computing devices such as the computer server 11 and/or smartphone device 13 illustrated in FIG. 1. The controller can include or have access to any number of different memory devices/databases 12 on which instructions can be provided for allowing the controller 10 to communicate with and control the operation of each of the PGU devices 20.

Although described above with respect to a server and smartphone, the invention is not to be construed as limiting thereto, as a computing device refers to any device with a processor and memory that can execute instructions. Computing devices include, but are not limited to, personal computers, server computers, and portable handheld electronic devices such as the smartphone 13, portable computers, laptop computers, personal digital assistants (PDAs), e-Readers, cellular telephones, e-mail clients, tablets and other mobile devices.

In this regard, portions of the control system can be implemented as a computer program product, i.e., a computer program tangibly embodied in a non-transient machine-readable storage device, for execution by, or to control the operation of, a data processing apparatus. The computer program can be written in any form of computer or programming language, including source code, compiled code, interpreted code, scripting code (e.g., Javascript) and/or machine code, and the computer program can be deployed in any form, including as a stand-alone program or as a subroutine, element, or other unit suitable for use in a computing environment.

In general, computer-readable storage mediums, such as the database 12, include all forms of volatile and non-volatile memory, including by way of example semiconductor memory devices, e.g., DRAM, SRAM, EPROM, EEPROM, and flash memory devices; magnetic disks, e.g., internal hard disks or removable disks; magneto-optical disks; and optical disks, e.g., CD, DVD, HD-DVD, and Blu-ray disks.

In various embodiments, the network 15 is a transmission medium that facilitates any form or medium of digital or analog communication (e.g., a communication network). Transmission mediums can include one or more packet-based networks and/or one or more circuit-based networks in any configuration. Packet-based networks can include, for example, the Internet, a carrier internet protocol (IP) network (e.g., local area network (LAN), and/or a wide area network (WAN). Circuit-based networks can include, for example, the public switched telephone network (PSTN), a wireless network (e.g., RAN, code-division multiple access (CDMA) network, time division multiple access (TDMA) network, global system for mobile communications (GSM) network), infrared transmissions, Bluetooth® or Personal Area Networks (PANs), Near Field Communication (NFC) network, and/or other circuit-based networks. Accordingly, it is to be understood that one or more components of the system 100 can communicate directly with one another, or can communicate through a network system.

Figure 2A:
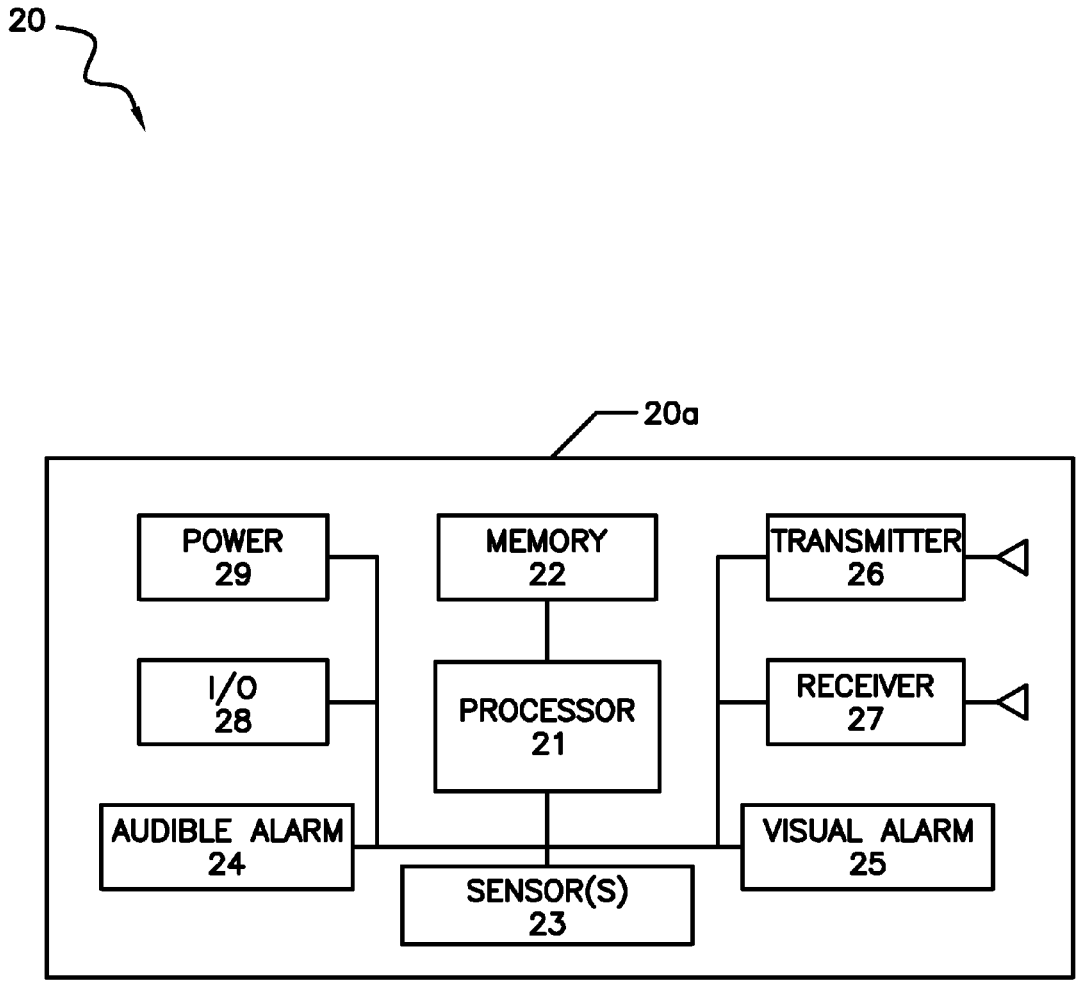
FIG. 2A is a schematic diagram of the perimeter generation unit, according to one embodiment of the invention.
Figure 2B:
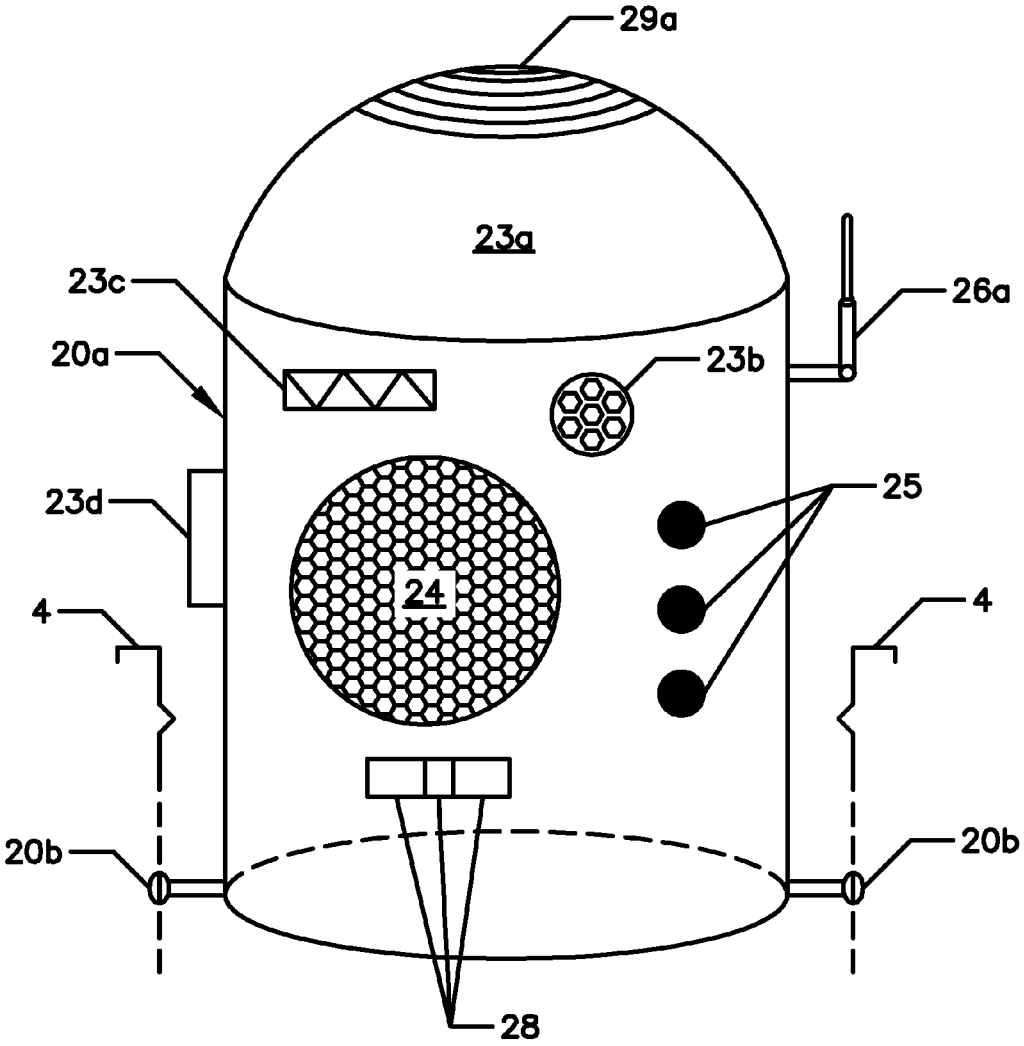
FIG. 2B is a front view of a perimeter generation unit, according to one embodiment of the invention.

FIGS. 2A and 2B illustrate one embodiment of a perimeter generation unit (PGU) 20 for use with the system of FIG. 1. In one embodiment, each PGU 20, can include an outer shell/main body 20*a* for housing, a processor 21 that is conventionally connected to an internal memory 22, one or more sensors 23, an audible alarm 24, a visual alarm 25, a transmitter 26, a receiver 27, a device input unit 28, and a power source 29.

Although the preferred embodiment of the device includes each of the elements 20*a*-29, other embodiments are also contemplated. For example, one or more PGU devices 20 can be constructed to include or exclude any combination of elements 24-28, depending on the intended use of the device and/or manufacturing costs. To this end, each of the one or more PGU devices can be manufactured in accordance with any number of known construction methodologies, and one or more of the internal components, although listed as separate elements, can be formed together to form a printed circuit board or other such component, for example, in accordance with known manufacturing processes.

The body 20*a* can act to securely position the internal components of the PGU 20 in a conventional manner. Additionally, the body itself can take any number of different shapes and sizes, and can be constructed from any number of known materials and construction methodologies. In one preferred embodiment, main body 20*a* can be constructed from injection molded plastic to form a weatherproof enclosure for protecting the internal components from inclement weather. In one embodiment, the outer body can include a shape that resembles a natural object, such as a rock, plant, tree stump and the like, and including appropriate markings/colors to camouflage the device itself. Of course, other known materials and manufacturing processes are also contemplated.

One or more of the PGU devices 20 can also include an attachment ring 20*b* which can mate with any number of conventional hardware such as the stakes 4, in order to firmly position/anchor the device to a desired location. Although illustrated as including a ring, the invention is not limited to such an arrangement. For example, any number of other attachment units such as strips of hook and loop material (i.e. Velcro®), adhesion materials such as glue or resin, double sided tape, and/or physical tethers, anchors and screws, for example, among other known fasteners, can be provided in order to secure the device 20 to any fixture such as a tree, for example, in either a permanent or temporary manner.

The processor 21 can act to execute program code stored in the memory 22 in order to allow the device to perform the functionality described herein. Processors are extremely well known in the art, therefore no further description will be provided.

Memory 22 can act to store operating instructions in the form of program code for the processor 21 to execute. Although illustrated in FIG. 2A as a single component, memory 22 can include one or more physical memory devices such as, for example, local memory and/or one or more bulk storage devices. As used herein, local memory can refer to random access memory or other non-persistent memory device(s) generally used during actual execution of program code, whereas a bulk storage device can be implemented as a persistent data storage device. Additionally, memory 22 can also include one or more cache memories that provide temporary storage of at least some program code in order to reduce the number of times program code must be retrieved from the bulk storage device during execution. Each of these devices is well known in the art.

One or more sensors 23 can be included within the device in order to detect the presence of another human or animal. In one embodiment, the PGU can include at least one infrared motion sensor 23*a* which can be positioned along the top portion of the main body, and can act to detect movement within a 360 degree area about the device 20. In this regard, the top portion of the main body 20*a* can include a construction material that does not affect the ability of the motion sensor 23*a* to send and receive signals.

In addition to detecting motion, the PGU devices can include other sensors for detecting the presence of others within the proximity of the device. For example, one or more of the PGU devices can also include a sound sensor 23*b* which can detect noises that are above any user defined threshold, and/or any number of photosensitive light sensors 23*c* that are capable of detecting the presence or absence of light and notifying the processor of the same. Further, the device can also include any number of inertial movement sensors 23*d* that are capable of detecting if/when the PGU itself is moved, and triggering a signal in response thereto. Several nonlimiting examples include mercury switches, non-mercury movement switches and/or an accelerometer that is implemented within the device such that when the sensor detects any movement of the device (e.g., in any plane or rotation), a signal can be generated and sent to the processor, which can then activate an alarm. In this manner, each PGU device can include a plurality of movement sensors that are either identical to each other or different from each other.

Moreover, the sensor(s) and/or processor and memory combination can also include programming wherein the device will not sound an alarm unless the detected movement is beyond a predetermined movement threshold. This threshold can preferably be established at a time of manufacture so as to avoid false alarms resulting from falling leaves and other natural occurrences, but can also be adjusted by the user via the controller 10 and/or the input device 28, for example.

The audible alarm can include, for example, a speaker 24 which can function to generate an audible noise such as an alarm tone, or pre-programmed voice, for example, to audibly notify a user when any of the sensors 23 have been activated. Likewise, the visual alarm can include one or more alarm lights 25 which can preferably comprise one or more LED's of varying colors and intensities. The light(s) can also be activated by the processor to present a visual notification in response to sensor activation.

In either instance, the system can preferably include functionality for allowing a user to determine whether or not they want the speaker 24 and/or light(s) 25 to be activated upon detection by one or more of the sensors. In this regard, the user can choose to provide no notice to an intruder that their presence within the perimeter has been detected.

The transmitter 26 and receiver 27 can function to send and receive information between a respective PGU 20 and the controller 10 and/or another PGU device. In this regard, the device can include an optional antenna 26*a* for augmenting the range of the device, and the transmitter and receiver can include any number of known devices or any single communication unit that is capable of communicating with an external device utilizing a communication protocol. Several non-limiting examples of suitable communication protocols for use herein can include, for example, Ethernet protocol, Internet Protocol (IP), Voice over IP (VOIP), a Peer-to-Peer (P2P) protocol, Hypertext Transfer Protocol (HTTP), Session Initiation Protocol (SIP), a Global System for Mobile Communications (GSM) protocol, a Push-to-Talk (PTT) protocol, a PTT over Cellular (POC) protocol, a Real-time Messaging protocol (RTMP), a Real-time Media Flow Protocol (RTMFP) and/or other communication protocols.

Additionally, one or more of the PGU devices can also include a variable radio wave transmitter having a unique radio frequency chip capable of transmitting a plurality of independent radio frequencies which are stored in the memory 22, and a variable radio wave receiver having a unique radio frequency chip capable of receiving and translating a plurality of independent radio frequencies which can be sent to the processor and/or the memory 21. Although described above as using radio transmission, reception and frequencies, other communication mediums and their associated components are also contemplated. For example, infrared (IR), Bluetooth®, RFID, microwave and other known communication mediums can also be utilized without deviating from the scope and spirit of the inventive concepts disclosed herein.

The device 20 can include one or more input units 28 such as push buttons, switches or other such members. These buttons can function to accept user inputs and provide instructions to the processor for controlling the operation of the device. In one embodiment, one or more of the buttons can be connected to the processor 21 so as to instruct the processor to switch between an active monitoring state and an inactivate monitoring state. To this end, whenever the device is in the active monitoring state, movement that is detected by the sensor(s) 23 will be reported to the processor and/or the controller 10 and, depending on the settings of a particular PGU, automatically trigger one or more of the alarms 24 and 25. Whenever the device is in the inactive monitoring state, the device can be powered off or operate in a standby mode wherein the sensors will not be active, and no alarm can be triggered.

In one preferred embodiment, the device 20 can include a compartment and removable cover (not illustrated) for receiving a power source 29 such as one or more DC batteries, for example. Moreover, an optional solar cell 29*a* can be provided along the main body 20*a*, in order to provide additional power to the device and/or an installed battery via the power of the sun. Of course, any suitable power source capable of providing the necessary power requirements to each element of the PGU 20 can also be utilized herein.

Figure 3:
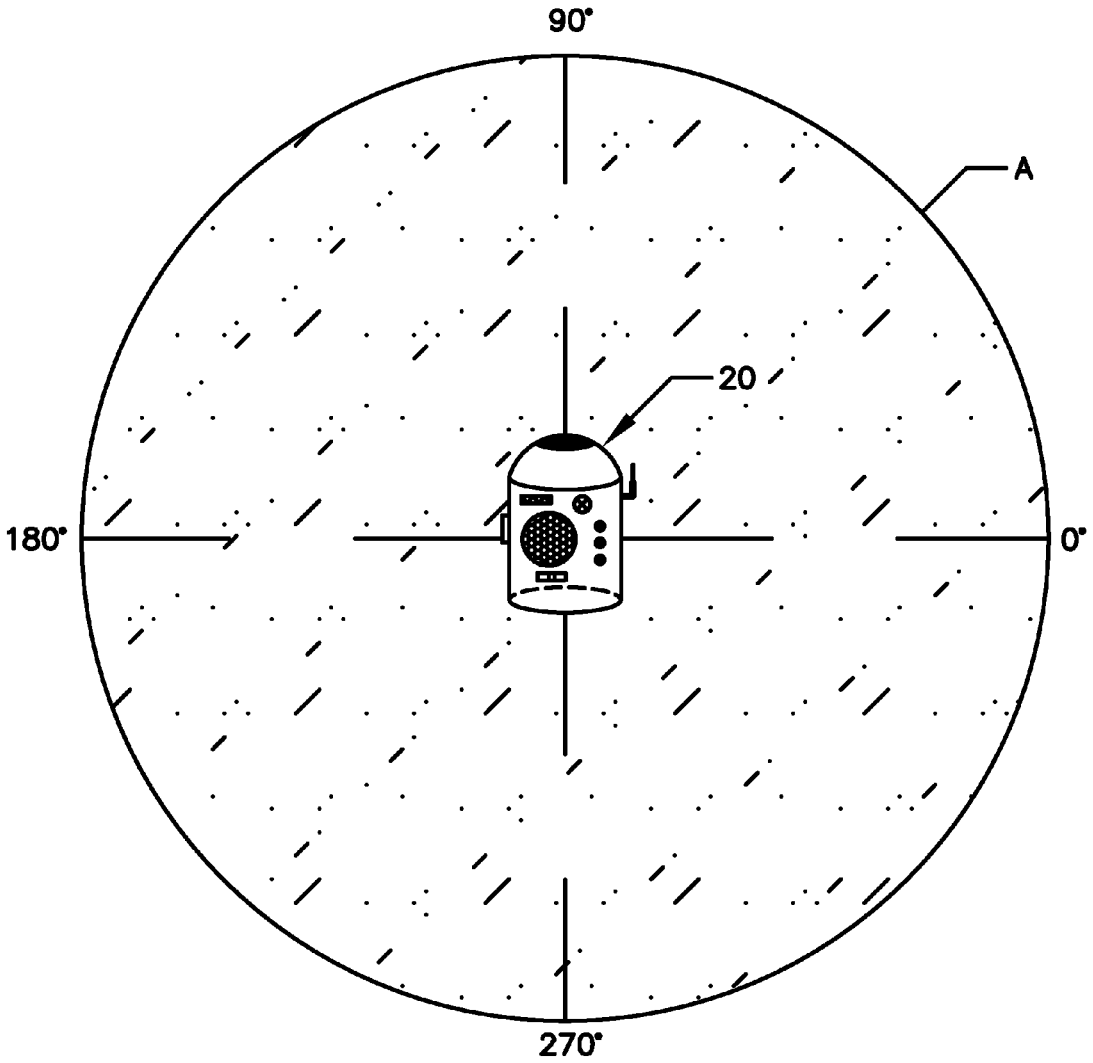
FIG. 3 is a top view of the coverage radius and coverage area of a perimeter generation unit, according to one embodiment of the invention.

As shown in FIG. 3, each PGU can preferably include functionality for adjusting a sensor coverage radius of between 0 and 360 degrees relative to the unit location, as well as the coverage area A extending outward from the unit. In one embodiment, the coverage area distance of each PGU device can range between approximately 5 and 20 feet from the device itself. Of course, any number of environmental factors such as terrain and elevation can affect the actual range. Moreover, it is contemplated that PGU devices can be constructed to cover any number of distances that are less than 5 feet and greater than 20 feet. In either instance, the sensor coverage radius and area can be performed on the unit itself via the input units 28, or through a communication from the controller 10.

Figure 4:
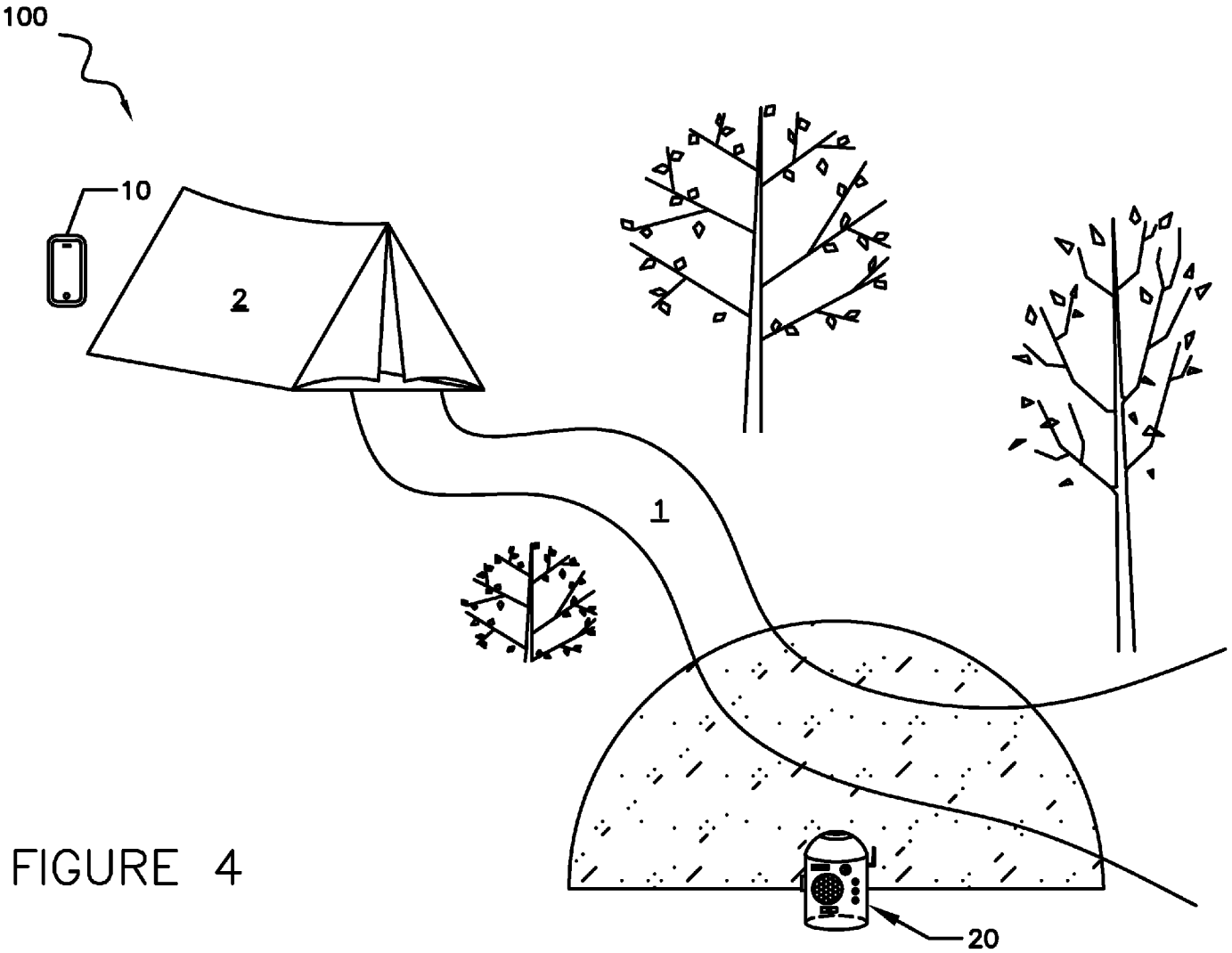
FIG. 4 is a perspective view of the wireless perimeter intrusion detection system in operation, in accordance with one embodiment of the invention.
Figure 5:
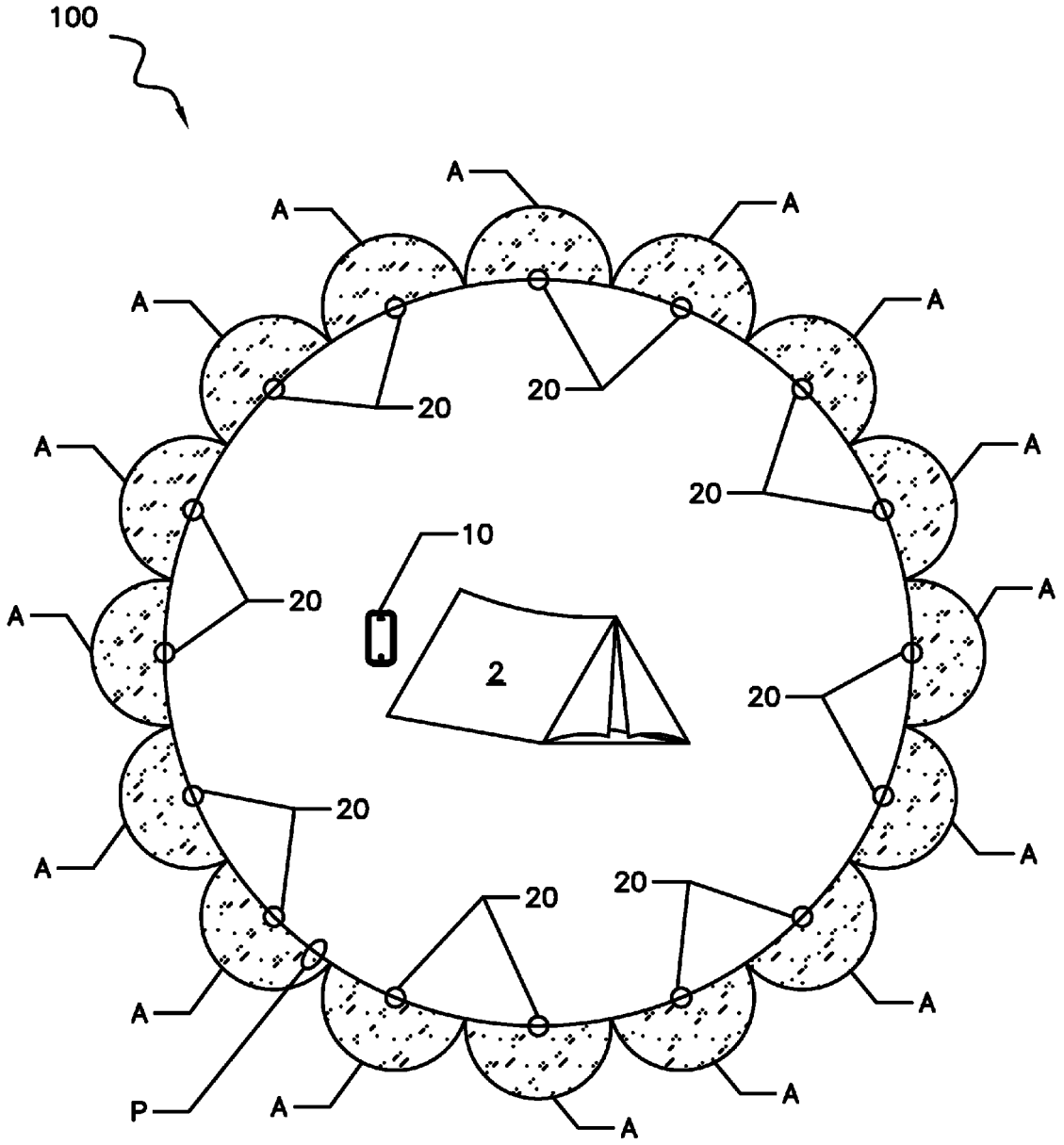
FIG. 5 is another perspective view of the wireless perimeter intrusion detection system in operation, in accordance with one embodiment of the invention.

As each of the PGU devices 20 are self-powered, portable and weatherproof, it becomes possible to utilize the system in any environment. To this end, FIGS. 4 and 5 illustrate various uses of the system in urban environments. For example, a single PGU device can be placed at a location such as a pathway 1, in order to warn a user that someone is approaching a particular location, such as a campsite 2, for example. Alternatively, any number of PGU devices can be arranged to have overlapping coverage area's A, in order to create a secure perimeter P. As such, anyone attempting to enter the perimeter will activate one of the PGU devices, wherein a warning can be sent to the controller 10. Such features can be particularly beneficial for military applications, as well as for outdoorsmen who establish camps within areas having dangerous wildlife, for example.

Once positioned at a desirable location, each of the PGU devices 20 can be communicatively linked with the controller 10, and/or one another. Once communication between the PGU device(s) and the controller 10 has been established, a user can be provided with options for utilizing each of the selected PGU devices. For example, a user can be presented with options for selectively activating one or more of the individual PGU devices, as well as specifying which particular sensor(s) within an activated PGU to turn on. Additionally, the system can function to allow a user to extend or retract the coverage radius and area of one or more of the active PGU devices, as well as transitioning the entire array of PGU devices 20 between the active and inactive monitoring states.

In this regard, once a PGU device has been activated, the sensor(s) can function to monitor a coverage area, and generate an alarm signal to the processor when the sensor is tripped (e.g., detects movement, light, sound, etc.). Once the alarm signal has been sent to the processor, the system can immediately notify the controller that an alarm situation has occurred. At this time, depending on the user specified settings, the system can selectively activate the audio and/or visual alarms on one or more of the PGU devices. In this regard, the system can function to generate an alarm signal from a first PGU device, and trigger the audio and/or visual alarm of multiple devices in response.

As described herein, one or more elements of each of the perimeter generation units 20 can be secured together utilizing any number of known attachment means such as, for example, screws, glue, compression fittings and welds, among others. Moreover, although the above embodiments have been described as including separate individual elements, the inventive concepts disclosed herein are not so limiting. To this end, one of skill in the art will recognize that one or more individual elements may be formed together as one continuous element, either through manufacturing processes, such as welding, casting, or molding, or through the use of a singular piece of material milled or machined with the aforementioned components forming identifiable sections thereof.

As to a further description of the manner and use of the present invention, the same should be apparent from the above description. Accordingly, no further discussion relating to the manner of usage and operation will be provided.

The terminology used herein is for the purpose of describing particular embodiments only and is not intended to be limiting of the invention. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

What is claimed is:

1. A wireless perimeter intrusion detection system, comprising:

a controller having at least one processor enabled device and a wireless communication unit; and at least one perimeter generation unit, comprising:

a portable weatherproof main body, at least one sensor that is positioned along the weatherproof main body, the at least one sensor having a coverage radius and a coverage area, an alarm that is positioned on or within the weatherproof main body, said alarm functioning to broadcast at least one of an audible and visual signal, a memory that is positioned within the main body, said memory being configured to store operating instructions, an input unit that is positioned on the main body, said input unit being configured to receive operating instructions, a communication unit that is positioned within the main body, said communication unit functioning to execute wireless communications with the controller, a processor that is positioned within the main body, and is in communication with each of the at least one sensor, the alarm, the memory, the input unit and the communication unit, and a power source that is positioned on or within the weatherproof main body.

2. The system of claim 1, wherein the at least one sensor includes at least one motion sensor and at least one of a sound sensor, a light sensor, and an inertial movement sensor.

3. The system of claim 1, wherein the coverage radius and the coverage area of the at least one sensor is adjustable by the controller and the input unit.

4. The system of claim 1, wherein the coverage radius includes an angle range between 0 and 360 degrees across a horizontal axis and relative to the perimeter detection unit.

5. The system of claim 1, wherein the coverage area includes a distance of between approximately 5 feet and 20 feet across a horizontal axis and relative to the perimeter detection unit.

6. The system of claim 1, wherein the sensor is configured to generate an alarm signal upon detection of movement that is beyond a predetermined movement threshold.

7. The system of claim 1, wherein the communication unit and controller are configured to communicate via, at least one of, a radio signal, an infrared signal, a Bluetooth signal, a microwave signal, a cellular signal and an RFID signal.

8. The system of claim 1, further comprising:

a solar cell that is disposed along the main body of the perimeter generation unit, said solar cell functioning to augment the power source.

9. The system of claim 1, wherein the alarm includes at least one of a speaker and an alarm light.

10. The system of claim 1, wherein the alarm includes each of a speaker and an alarm light.

11. The system of claim 1, wherein the portable weatherproof main body includes a shape comprising, at least one of a rock, a plant and a tree stump.

12. The system of claim 1, wherein the controller consists of:

a portable handheld electronic device.

13. A wireless perimeter intrusion detection system, comprising:

a controller having at least one processor enabled device and a wireless communication unit; and a plurality of perimeter generation units, each of said units comprising:

a portable weatherproof main body, at least one sensor that is positioned along the weatherproof main body, the at least one sensor having a coverage radius and a coverage area, an alarm that is positioned on or within the weatherproof main body, said alarm functioning to broadcast at least one of an audible and visual signal, a memory that is positioned within the main body, said memory being configured to store operating instructions, an input unit that is positioned on the main body, said input unit being configured to receive operating instructions, a communication unit that is positioned within the main body, said communication unit functioning to execute wireless communications with the controller, a processor that is positioned within the main body, and is in communication with each of the at least one sensor, the alarm, the memory, the input unit and the communication unit, and a power source that is positioned on or within the weatherproof main body.

14. The system of claim 13, wherein each of the plurality of perimeter generation units are configured to communicate with each other directly.

15. The system of claim 13, wherein the at least one sensor of each of the plurality of perimeter generation units include a motion sensor and at least one of a sound sensor, a light sensor, and an inertial movement sensor.

16. The system of claim 13, wherein each of the plurality of perimeter generation units are configured to generate at least one of the audible and visual signal when any of the plurality of perimeter generation units generates an alarm signal.

17. The system of claim 13, wherein the portable weatherproof main body of each of the plurality of portable perimeter generation units includes a shape comprising, at least one of a rock, a plant and a tree stump.

18. The system of claim 13, wherein the at least one sensor of each of the plurality of perimeter generation units includes both a motion sensor and a sound sensor.

19. The system of claim 13, wherein the at least one sensor of one of the plurality of perimeter generation units is different than the at least one sensor of another of the plurality of perimeter generation units.

20. The system of claim 13, wherein the controller consists of:

a portable handheld electronic device.

* * * * *